United States Patent [19]

Juaire et al.

[11] Patent Number: 4,670,918

[45] Date of Patent: Jun. 9, 1987

[54] URINAL FOR USE WITH A PORTABLE TOILET STRUCTURE

[75] Inventors: Phillip R. Juaire; Duane T. Tegg, both of Brooklyn Center, Minn.

[73] Assignee: Satellite Industries, Inc., Minneapolis, Minn.

[21] Appl. No.: 900,188

[22] Filed: Aug. 25, 1986

[51] Int. Cl.[4] ..... A47K 4/00

[52] U.S. Cl. ..... 4/463; 4/462; 4/DIG. 5

[58] Field of Search ..... 4/301, 300.3, 310, 311, 4/114.1, 459, 460, 461, 462, 463, 144.1, DIG. 5, DIG. 15

[56] References Cited

U.S. PATENT DOCUMENTS

| | | | |
|---|---|---|---|
| 211,078 | 1/1879 | Adee | 4/311 |
| 268,379 | 12/1882 | Baldwin | 4/311 |
| 2,431,330 | 11/1947 | Johnson | 4/311 |
| 3,066,311 | 12/1962 | Tharp | 4/462 |
| 3,447,167 | 6/1969 | Harding | 4/462 |
| 3,629,874 | 12/1971 | Beller | 4/462 |
| 3,835,480 | 9/1974 | Harding | 4/462 X |
| 3,992,727 | 11/1976 | Elkins | 4/311 |
| 4,031,572 | 6/1977 | Harding | 4/463 X |
| 4,285,077 | 8/1981 | Braxton | 4/462 |
| 4,380,836 | 4/1983 | Braxton | 4/462 |

*Primary Examiner*—Henry K. Artis

*Attorney, Agent, or Firm*—Herman H. Bains

[57] ABSTRACT

A urinal for use with a portable restroom unit is formed of plastic and includes a unitary urinal body, including rear, side, bottom and front walls. Front and rear shelves are integral with front and rear walls, respectively, and cooperate with front and rear locking elements for supporting a screen. Attachment tabs project from the rear and bottom walls to permit attachment of the urinal to a wall of the portable restroom unit. A tubular drain tube is integral with the urinal and includes large and small diameter portions to permit selective connection to large and small diameter drain tubes.

9 Claims, 5 Drawing Figures

URINAL FOR USE WITH A PORTABLE TOILET STRUCTURE

This invention relates to a urinal and, more particularly, to a urinal used with a portable toilet structure.

BACKGROUND OF THE INVENTION

Various types of portable restroom units are extensively used at construction sites, outdoor concerts, sporting events, and the like. These portable restroom units are usually chemical units that include a urinal, which is attached to an inner wall surface of the unit. Screws, nails, or the like are used to secure the urinal to the wall, and these attachment screws are applied to the interior of the urinal and are subject to corrosion.

Urinals used in conjunction with chemical portable restroom units are usually connected to the chemical holding tank by means of a short tube to permit drainage into the holding tank. The drainage tube is connected to the drain outlet which projects outwardly from the urinal. The drain outlet for many urinals will accommodate only one sized drain tube, although the drain tubes for holding tanks of the various commercial units include a large or a small sized tube.

Finally, most urinals used with portable restroom units, and known to Applicant, are not provided with a screen for preventing debris from clogging the outlet drain. Certainly, there are no urinals with means for securely locking a screen in place and permitting ready removal of the screen when desired.

SUMMARY OF THE INVENTION

It is an object of this invention to provide a novel and improved molded plastic urinal, of simple and inexpensive construction, which is adapted to be connected to the interior of a portable restroom unit in a manner to minimize corrosion and failure of the securing elements.

Another object of this invention is the provision of a novel molded plastic urinal for use with a portable restroom unit and including a drain outlet integral with the urinal and having large and small diameter portions for accommodating large or small diameter drain tubes.

A further object of this invention is to provide a novel molded plastic urinal for use with a portable restroom unit and including support and locking means for supporting and releasably locking a screen therein.

These and other objects of the invention will be more fully defined in the following Specification.

FIGURES OF THE DRAWING

DESCRIPTION OF THE PREFERRED EMBODIMENT

Figure 1:
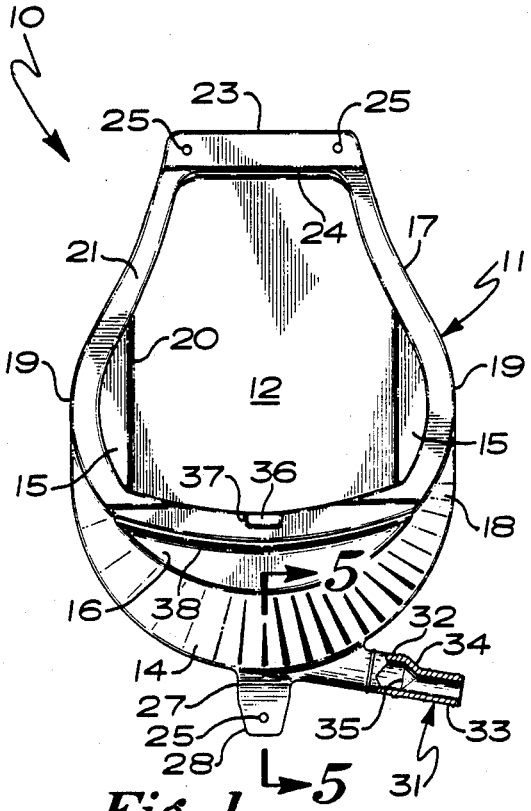
FIG. 1 is a front elevational view of the novel unit.

Referring now to the drawings and, more specifically to FIG. 1, it will be seen that the novel urinal, designated generally by the reference numeral 10, is comprised of a single piece molded plastic urinal body 11.

Figure 2:
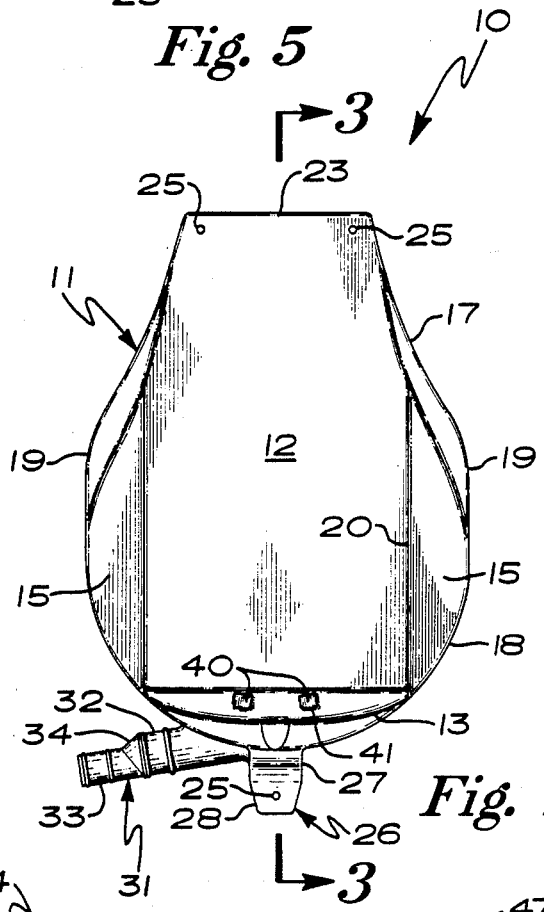
FIG. 2 is a rear elevational view thereof.

The urinal body 11 includes a substantially vertical flat rear wall 12, which terminates downwardly in a lower portion 13, which extends downwardly and forwardly, as best seen in FIG. 2.

The urinal also includes a bottom wall 14, which is integral with the lower wall portion 13 of the rear wall and extends generally upwardly and forwardly therefrom. Referring now to FIG. 1, it will also be noted that the bottom wall 14 is curved transversely and is integral with and merges into the lower portions of the side walls 15.

The side walls 15 are generally vertically disposed and include an upper portion 17 and a lower portion 18. It will be noted that the upper portion 17 of each side wall flares downwardly and outwardly to an enlarged waist 19, and the lower portion 18 flares downwardly and inwardly from the enlarged waist 19 and merges into the lower wall 14. It will also be noted that the side walls flare forwardly and outwardly from the vertical edge lines 20 of the rear wall 12 and then flare forwardly and inwardly and terminate in an inturned flange 21.

The front wall 16 projects generally upwardly and inwardly or rearwardly from the bottom wall and has a vertical dimension substantially less and only a fraction of the vertical dimension of the rear wall 12. Thus, the interior 22 of the urinal body 11, when attached to a wall W, drains rearwardly towards the lower portion 13 of the rear wall 12.

Means are provided for attaching the urinal body 11 to a wall of a portable restroom, and this attachment means includes a substantially flat vertically disposed upper tab 23, which is integral with the rear wall 12 and which projects upwardly therefrom. The upper tab 23 is also integral with an upper, transversely extending generally horizontal flange 24, which is integrally formed with a side wall flange 21 of the side walls 15. It will be seen that the upper tab 23 is of generally rectangular configuration and is provided with a pair of laterally spaced apart openings 25 therein for accommodating nails, screws, rivets, or the like for attaching the urinal to a vertical wall of a portable restroom unit. It will further be noted from FIG. 3 that the rear surface of the upper tab 23 is disposed in coplanar relation with the rear surface of the rear wall 12 so that the rear wall is positioned flush against the vertical wall of the associated portable restroom unit.

Figure 3:
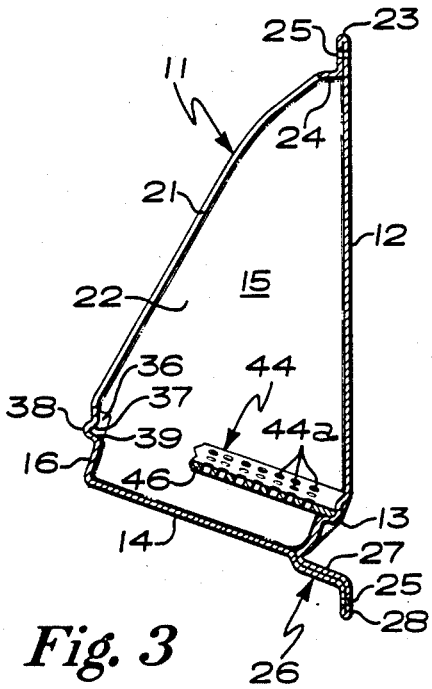
FIG. 3 is a cross-sectional view taken approximately along the line 3—3 of FIG. 2 and looking in the direction of the arrows.
Figure 4:
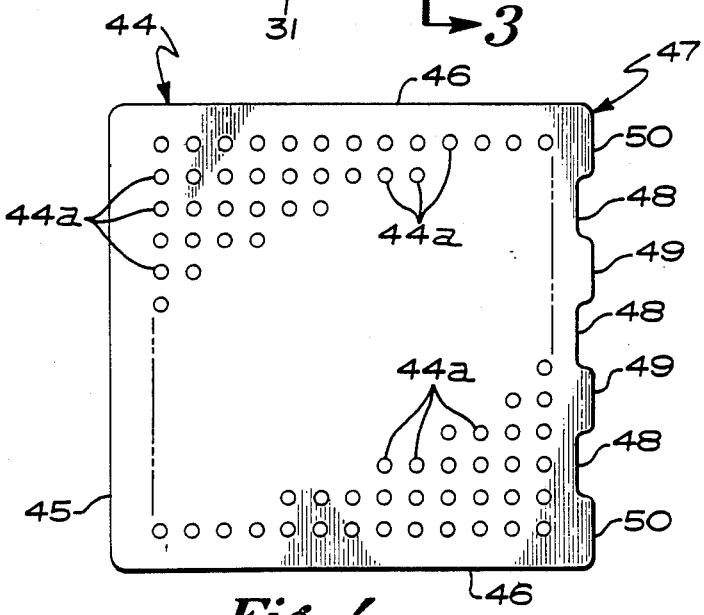
FIG. 4 is a top plan view of the screen for the urinal.

The urinal body 11 is also provided with a lower attachment tab 26, which is integrally formed with the urinal body at approximately the juncture line between the lower portion 13 of the rear wall and the bottom wall 14, as best seen in FIG. 3. It will be noted that the lower attachment tab 26 includes a rearwardly inclined portion 27, which is integral with a downwardly projecting terminal portion 28. The downwardly projecting terminal portion 28 has an opening 29 therein for accommodating an attachment element, such as a nail, screw, rivet, or the like.

In the embodiment shown, it will be seen that the downwardly projecting terminal portion 28 has its rear surface disposed in coplanar relation with the rear surface of the rear wall 12. However, it is pointed out that, in certain portable restrooms, the vertical walls are provided with ribs and indentations and the terminal portion 28 in such instances will project rearwardly beyond the general plane of the rear wall 12 for engagement with the recess in the vertical wall. It will further be noted, as best seen in FIG. 1, that the lower attachment tab is centrally located with respect to the bottom wall 14.

Figure 5:
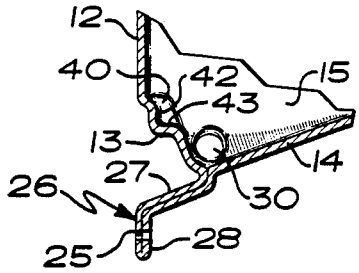
FIG. 5 is a cross-sectional view taken approximately along the line 5—5 of FIG. 1 and looking in the direction of the arrows.

The urinal 10 is also provided with a drain opening 30, which is located at the juncture between the lower wall portion 13 of the rear wall and the bottom wall 14, as best seen in FIG. 5. The drain opening 30 communicates with a drain outlet 31 which projects tangentially laterally outwardly and downwardly from the urinal body. It will be noted that the drain outlet 31 is molded integrally with a urinal body and includes a large diameter portion 32, which terminates in a smaller diameter portion 33. It will be noted that the lower arcuate sector of the large and smaller diameter portions is coextensive so that there will be no interference with the flow of liquid by action of gravity through the drain outlet. The drain outlet 31 includes a tapered sector portion 34, which merges into the lower coextensive sector of the drain outlet. With this arrangement, when it is desirable to use a small drain tube with a drain outlet, it is only necessary to slide the small drain tube over the small diameter portion 33 of the drain outlet. On the other hand, if a larger diameter drain tube is to be used in conjunction with the drain outlet, a user will cut the drain outlet 31 along the cut line 35, leaving only the large diameter portion for connection to the drain tube.

The front wall 16 of the urinal body 11 is provided with a centrally located inwardly projecting front locking element 36, which is molded into the front wall and which, in the embodiment shown, is of generally rectangular configuration. The front locking element has a downwardly facing locking surface 37, the function of which will be more fully explained hereinbelow. The front wall 16 is also provided with a molded in outwardly projecting protuberance 38, which is transversely curved, and which presents a supporting shelf 39, the latter being also transversely curved.

The lower portion of the rear wall 12 is also provided with a pair of transversely spaced apart inwardly projecting rear locking elements 40, each of which is of generally rectangular configuration, and each being molded in the lower wall portion 13. Each of the inwardly projecting rear locking elements 40 define a downwardly facing locking surface 41. The lower portion 13 of the rear wall 12 is also provided with an outwardly projecting molded in protuberance 42, which defines a supporting shelf 43, which is transversely curved. It will be noted that the supporting shelf 43 is positioned below the locking surface 41 for the rear locking elements and that the supporting shelf 39 is positioned below the locking surface 37 of the front locking element 36.

The urinal 10 also includes a drain screen or filter, which is of generally rectangular configuration, and which is formed of a suitable flexible plastic material, such as polyethylene or the like. In the embodiment shown, it is preferred that high density polyethylene be used, but that the drain screen 44 be somewhat flexible. It will be seen that the generally rectangular shaped drain screen 44 includes a substantially straight front edge 45, substantially straight parallel side edges 46, and a rear edge 47. The rear edge 47 has a plurality of spaced apart recesses 48 therein which define a pair of laterally spaced apart rearwardly projecting central tabs 49 and a pair of rearwardly projecting outer tabs 50.

The drain screen 44 may be readily inserted in releasably locked relation with respect to the urinal body 11 and, when the screen is installed, the front edge of the screen is positioned under the locking surface 37 of the front locking element, and the front edge is also supported on the supporting shelf 39. The central tabs 49 will be positioned under the downwardly facing locking surfaces 41 of the rear locking elements 40 and the central and outer tabs will be positioned on the supporting shelf 43. Since the supporting shelf 49 and the supporting shelf 43 are curved transversely, the drain screen will be flexed downwardly so that it presents a somewhat downwardly concave upper surface when installed.

The use of the upper and lower tabs located exteriorly of the urinal interior provides means for readily attaching the urinal to a vertical wall of a portable restroom unit and further assures that these attachment elements will not fail as a result of corrosion. The central location of the lower attachment tab in its relation with the upper tab further provides effective means of securing the urinal to the portable restroom unit wall.

The provision of a drain outlet having large and small diameter portions enhances the adaptability of the urinal, since the unit can be used with both a large or small diameter drain tube.

Finally, it will be seen that the molded in support and locking features of the urinal body provide means for effectively locking and supporting the drain screen, which may be readily installed or removed, as desired, for cleaning, replacement or transport.

Thus, it will be seen that I have provided a novel urinal for use with a portable restroom unit, which is not only of simple and inexpensive construction, but one which functions in a more efficient manner than any heretofore known comparable unit.

What is claimed is:

1. A urinal for use with a portable toilet structure, comprising:

a single piece molded urinal body formed of a moldable plastic including a substantially flat vertically disposed rear wall, a front wall, a curved bottom wall, and vertically disposed curved side walls, said rear wall terminating downwardly in a lower portion which extends downwardly and forwardly therefrom, said bottom wall extending downwardly and rearwardly from said front wall, means on said urinal body for attachment to the wall of a portable toilet structure, generally horizontally disposed shelf means integral with said urinal body, a screen engaging said front and rear shelves and being supported thereby, lock means integral with said urinal body and being located above said shelf means, said lock means engaging said screen and cooperating with said shelf means to releasably retain the screen in supported relation on the shelf means, and a drain outlet integral with said bottom wall and communicating with the interior of said urinal body and projecting outwardly therefrom.

2. The urinal as defined in claim 1 wherein said drain outlet is of tubular configuration and includes a large diameter portion and a small diameter portion, thereby permitting selective connection thereto of a large or small diameter drain tube.

3. The urinal as defined in claim 1 wherein said attachment means comprises an upper tab integral with said rear wall and projecting upwardly therefrom, and a lower tab integral with said bottom wall and projecting downwardly therefrom, each tab having an opening therein for accommodating an attachment element, such as a bolt, screw, rivet or the like.

4. The urinal as defined in claim 3 wherein said attachment tabs are disposed on the same general vertical plane of said rear wall of the urinal body.

5. The urinal as defined in claim 1 wherein said screen is formed of a somewhat flexible plastic material.

6. The urinal as defined in claim 1 wherein said shelf means comprises a generally horizontal front shelf integral with said front wall and extending transversely thereof and a generally horizontal rear shelf integral with said rear wall and extending transversely thereof.

7. The urinal as defined in claim 6 wherein said locking means comprises a front locking element integral with the front wall and being spaced above said front shelf, and a rear locking element integral with said rear wall and being spaced above said rear shelf.

8. The urinal as defined in claim 7 and a second rear locking element integral with said rear wall and spaced above said rear shelf, said second rear locking element being spaced laterally of said first mentioned rear locking element.

9. A urinal for use with a portable toilet structure, comprising:

a single piece molded urinal body formed of a moldable plastic including a substantially flat vertically disposed rear wall, a front wall, a curved bottom wall, and vertically disposed curved side walls, said rear wall terminating downwardly in a lower portion which extends downwardly and forwardly therefrom, said side walls flaring first outwardly and forwardly from said rear wall, and then flaring inwardly and forwardly, said side walls flaring downwardly and outwardly to a central waist, and then curving downwardly and inwardly toward said bottom wall, said bottom wall being integral with the lower portion of said rear wall and extending forwardly and upwardly therefrom, said bottom wall flaring downwardly and inwardly from said side walls, said front wall being integral with said bottom and side wall and extending upwardly and inwardly from said bottom wall, a drain outlet integral with said bottom wall and communicating with the interior of said urinal body and projecting outwardly therefrom, a pair of attachment tabs, one of which is integral with the upper portion of said rear wall and projecting upwardly therefrom, the other of said tabs being integral with said bottom wall and projecting downwardly therefrom, said tabs each having an opening therein to permit attachment of the urinal body to the inner wall of a portable toilet structure, support means on said front and rear walls, a perforated screen formed of a plastic material and being positioned on said support means, and molded in locking means on said front and rear walls engaging said perforated screen and cooperating with said support means for releasably retaining the latter in supported relation on said support means.

* * * * *